United States Patent [19]

Schoenberger

[11] 3,949,730

[45] Apr. 13, 1976

[54] ARCHERY BOW WITH FISHING REEL SUPPORTING BRACKET

[76] Inventor: Simon Ray Schoenberger, 1806 Bridge City Ave., Bridge City, La. 70094

[22] Filed: Nov. 18, 1974

[21] Appl. No.: 524,669

[52] U.S. Cl. ..... 124/24 R; 124/30 B; 43/19; 43/22

[51] Int. Cl.² ..... F41B 5/00

[58] Field of Search ..... 124/30 R, 30 B, 24 R, 41, 124/23 R, 30, 24, 23; 43/19, 22; 248/316 R

[56] References Cited

UNITED STATES PATENTS

| | | | |
|---|---|---|---|
| 2,802,461 | 8/1957 | Vance | 124/41 A |
| 2,863,251 | 12/1958 | Ackerman | 43/22 X |
| 2,938,514 | 5/1960 | Berg | 124/24 R |
| 3,084,467 | 4/1963 | Bromwell | 43/22 X |

*Primary Examiner*—Richard C. Pinkham
*Assistant Examiner*—William R. Browne
*Attorney, Agent, or Firm*—Pugh & Keaty

[57] ABSTRACT

A device for removably attaching various types of commercial fishing spinning reels to conventional archery bows for use in any sport or activity where a retrievable arrow must be used connected to a line, one end of which is attached to the arrow and the other end to a reel on the bow. Both the reel and the bow may be later easily separated and used for their original purpose, but while assembled as a unit, form a system of proved economy and efficiency, for instance, in fishing with the bow either under or above salt or fresh water. The adapter device of the present invention includes three parts: (a) a first vertical mounting bracket for attaching the device to the bow; (b) an intermediate, horizontal, transverse section; and (c) a second, horizontal mounting bracket upon which is mounted the standard fishing spinning reel through its standard foot mount. The second, horizontal bracket includes at its leading edge a lateral slot and at its trailing edge a compressive screw tab, both of which directly mate with the leading and trailing tips of the standard foot mount of the spinning reel. The adapter has slots that are used to receive straps that are for attaching the adapter to a bow.

12 Claims, 5 Drawing Figures

ARCHERY BOW WITH FISHING REEL SUPPORTING BRACKET

BACKGROUND OF THE INVENTION

The present invention relates to a system for combining together, by means of an adapter, a standard fishing spinning reel with an archery bow to produce a combination that can be used for bow-fishing with a retrievable arrow, either above or under salt or fresh water or similar uses.

The practice of archery has reached a high degree of perfection and so has the art of fishing by means of rod and reel; however, the two arts have not yet been effectively combined in fishing, hunting, and similar sports and uses where a line-attached retrievable arrow is necessary.

By providing a suitable adapter for attaching spinning reels to conventional bows, the present invention effects a bridge between the art of the rod and reel and the art of the bow and arrow. It allows the sportsman to place his spinning reel upon his archery bow, giving a device for shooting and retrieving fish or other small game; at the same time, he can, in a matter of seconds, dismantle this combination, and again use his bow and reel for their respective purposes without change.

Before the invention of the spinning reel, and its acceptance in actual practice, ordinary reels were installed permanently on fishing bows, the back-lash effect from an arrow was much worse than any encountered in ordinary casting; for this reason, such devices were ineffective, unless a special back-lash device was used. The present invention takes into consideration the favorable features of the spinning reel as regards to back-lash. The development of the sport of bow-fishing, or spearing fish with arrows, has reached a stage where a device such as the present invention is needed to allow the sportsman to combine temporarily his fishing and archery equipment when necessary, without going to the expense of purchasing additional or special equipment. The inventor knows of no simple, reliable device in the prior art that will allow the sportsman to do this quickly and easily.

Typical examples of the prior art showing the combination of archery bows and line reels are listed below:

| Inventor(s) | Patent Number | Issue Date |
|---|---|---|
| J.J. Adams | 736,051 | August 11, 1903 |
| H.E. Myers | 2,812,756 | November 12, 1957 |
| L.S. Meyer, et al | 2,873,929 | February 17, 1959 |
| P.E. Podufal | 2,904,338 | September 15, 1959 |
| H.C. Stockfleth | 2,918,049 | December 22, 1959 |
| R.L. Berg | 2,938,518 | May 31, 1960 |
| H.O. Moore | 3,059,370 | October 23, 1962 |
| F.K. Bromwell | 3,084,467 | April 9, 1963 |
| H.F. Ellenburg | 3,227,454 | January 4, 1966 |
| C.A. Saunders | 3,522,916 | August 4, 1970 |

As to the over-all structural combination of the present invention, the Bromwell U.S. Pat. No. 3,084,467 is perhaps the most relevant of the prior art.

It is the principal purpose of the invention to allow any size of ordinary spinning reel to be easily installed upon and removed from any conventional bow by utilizing a specially designed mounting adapter. This is done for the reel by making the part of the adapter upon which the reel is mounted directly mate with the mounting foot provided on all standard fishing spinning reels. As regards the bow, the part of the adapter that is attached to the bow has provisions for mounting slots and holes, so that the adapter can be made to fit any particular bow.

Another, ancillary purpose of the invention is to improve the prior art by not interfering with the archer's line of sight. This is done by placing the reel on one side of the bow and the arrow on the other. The angles of sight are such that the archer, aiming down the length of the arrow, has an unobstructed view.

A novel aspect of the invention is the provision for the ready disassembly of the reel from the bow, so that the bow may be instantly used without interference, as in ordinary archery. This is done by the design of the adapter at the point of attachment to the bow. The reel can be kept attached to the adapter and instantly locked into place on the bow when needed.

Another improvement over prior art, is that the invention allows the speared fish to be played by the archer using the bow as in the general manner of a fishing rod. After the fish is speared, the archer can grasp his bow with one hand and manipulate the crank handle of the spinning reel with the other, and thus "play" the fish and retrieve it. The fact that the reel is on one side of the bow and the arrow on the other improves the safety of some of the prior art.

The attachment of the line to the rear or notched end of the arrow improves accuracy and safety by improving the aerodynamic stability of the arrow in flight.

The reel is almost in direct level with the position of the arrow when on the bow string; this contributes to greater accuracy.

BRIEF DESCRIPTION OF THE DRAWINGS

For further understanding of the nature and objects of the present invention, reference should be had to the following detailed description, taken in conjunction with the accompanying drawings, in which like parts are given like reference numerals and wherein.

DESCRIPTION OF THE PREFERRED EMBODIMENT(S)

The objectives and advantages of the present invention are achieved by providing a special adapter that allows standard or common spinning reels to be removably attached to conventional archery bows, in such manner that the arrow of the bow can be retrieved by a line or cord that connects its rear portion with the reel.

Figure 1:
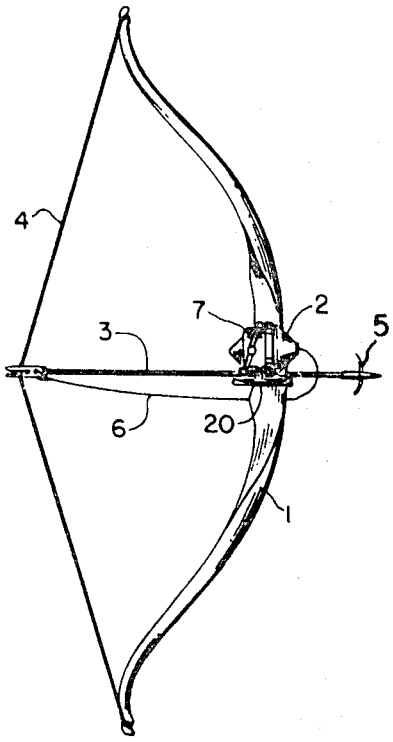
FIG. 1 is a side view of the combination of the present invention showing a typical spinning reel installed upon a conventional bow by means of the adapter of the present invention, with the arrow in place and attached at its notched or fleched end to the line of the reel.
Figure 2:
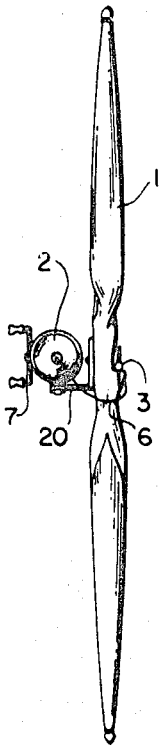
FIG. 2 is a front view of the combination of FIG. 1 showing the arrow on one side of the body of the bow the reel on the other side, and the connecting line running between them.
Figure 4:
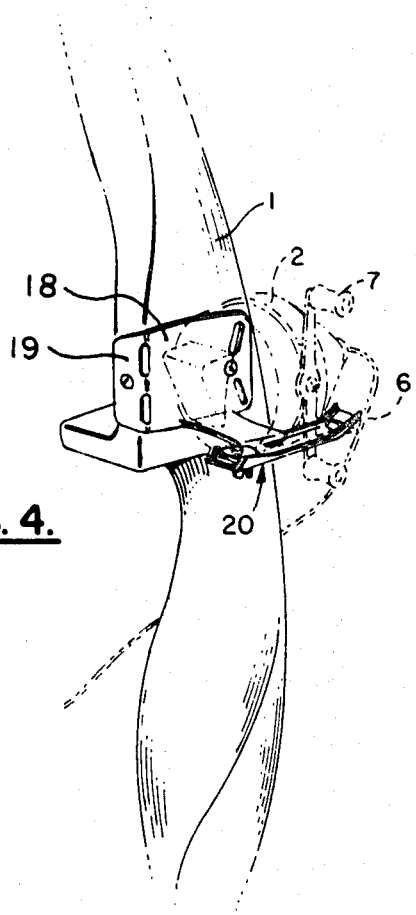
FIG. 4 is a perspective, partial, side view of the combination of FIG. 1 with the reel and line illustrated in phantom line.

Referring now to the drawings, and particularly to FIGS. 1, 2 and 4, the fishing-archery combination of the present invention for use by an archery fisherman is shown from several views and includes an archery bow 1, a standard type fishing spinning reel 2 mounted in place on the bow 1 by means of the special adapter 20, and a captive-type arrow 3 mounted on one side of the bow resting on a support ledge and in engagement with the bow string 4. The arrow 3 embodies a shaft with an arrowhead 5 at its leading end constructed to pierce and embed itself in a victim fish or the like. A fishing line 6 is attached at one end to the shaft of the arrow inwardly of the arrowhead 5, for example at the trailing end of the shaft, and the other cooperating end is wound on the reel 2. Note particularly FIGS. 1 and 2.

Figure 5:
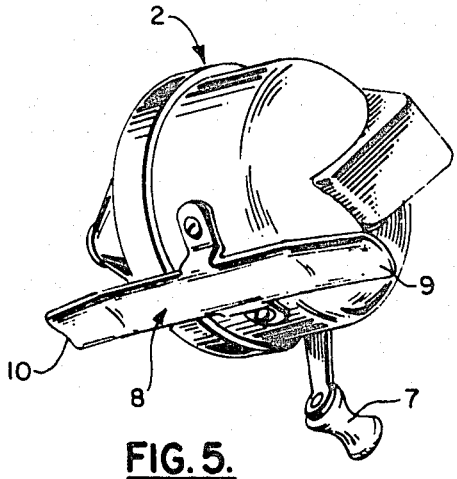
FIG. 5 is a bottom, perspective view of a standard fishing spinning reel, showing the standard mounting foot which directly mates with the adapter of the present invention.

The adapter 20, which is the essential element of the present invention, is shown in close-up detail in FIG. 4, which is a perspective view of the special adapter of the present invention; while the fishing reel 2 is shown in close-up detail in FIG. 5. As illustrated best in FIG. 5, the standard reel 2 includes at its bottom the standard mounting foot 8, specially designed for mating with appropriate mounting means on standard fishing rods, and includes a trailing tip 9 and a leading tip 10. A suitable crank handle 7 is included in the reel 2 for manually reeling up the line 6.

The reel 2 illustrated in FIG. 5 is a standard spinning reel used for fishing, such as for example the "Model 800" spinning reel manufactured by "Zebco" (Zebco, P.O. Box 455, Bonner Springs, Kans. 66012). Another type of standard spinning reel, wherein the mounting foot extends up from the top, rather than being attached to the bottom, of the spinning reel, is generally illustrated in the Bromwell U.S. Pat. No. 3,084,467 referred to above. A typical example of this latter type of reel is the "Model 4290" by "Daiwa" (Daiwa Corporation, 1526 West 166th Street, Gardena, Calif. 90247). As brought out more fully below, the special adapter 20 of the present invention can also be easily adapted to the latter of spinning reel.

As best shown in FIG. 4, the preferred embodiment of the special adapter 20 of the present invention includes three elemental sections — a first mounting bracket 17 for attaching the adapter 20 to the bow 1, an intermediate arm 16, and a second mounting bracket 15 for mounting the reel 2 onto the bow 1.

The first mounting bracket 17 comprises two flat vertical wall sections 18, 19 at 90° to one another, both of which contact the bow 1. The first wall section 18 is connected to the intermediate arm section 16 at the terminal edges of each other and contacts the side of the bow 1 opposite from that on which the arrow 3 is mounted or is associated with. The other wall section 19 is connected to the trailing edge of the first wall section 18 and contacts the back of the bow 1 (note FIG. 4).

Figure 3:
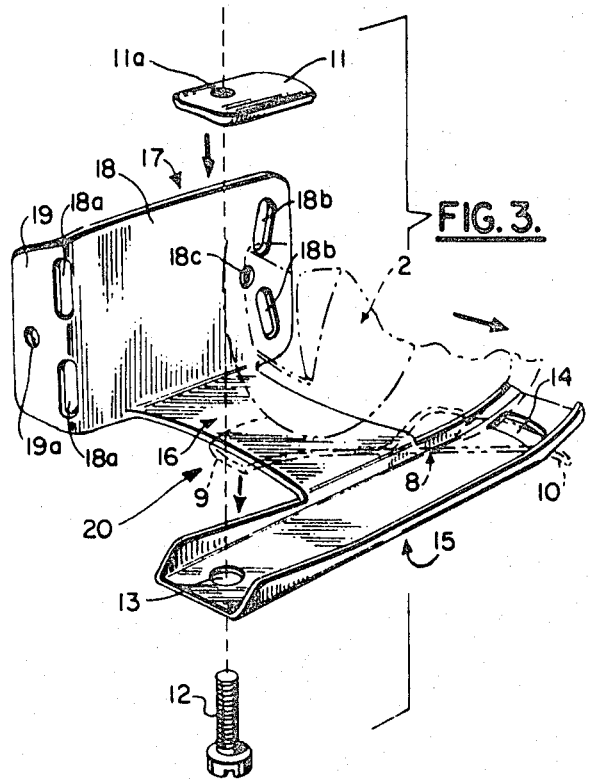
FIG. 3 is a perspective view of the special adapter of the present invention for easy mounting and removability in attaching the reel to the bow, with the compressive screw tab shown in exploded array and the reel in phantom line.

As seen in FIG. 3, the first wall section 18 includes in its main body two diverging slots **18*b* which run in a generally vertical direction, forming a small acute angle with the vertical. The slots 18*b* can be used in association with vertical slots 18*a* to mount the adapter 20 onto the bow 1 by means of two straps (not illustrated) rather than using wood screws which could mar the bow, the straps being passed through the slots 18*a* and 18*b* and around the body of the bow 1 and fastened with suitable buckles. The slant of the slots 18*b* match the configuration or curvature of the bow. The wall sections 18, 19 also include screw holes 18*a*, 19*a*, respectively, for mounting of the adapter 20 to the bow 1 (note screws in FIG. 4**).

The intermediate arm section 16, which is basically flat, is horizontally disposed and transversely joins the two mounting brackets 15, 17 together at opposite ends thereof.

As best seen in FIGS. 3 and 4, the second mounting bracket 15 for the reel 2 comprises a longitudinally extended main body which is at least generally horizontally disposed and has at its leading end a slightly upturned lip and two vertical edges along its sides. The upturned lip and the side edges serve to guide and position the foot 8 when the reel 2 is being mounted on the bracket 15, as will be understood more fully below.

At its leading end at the beginning of the upturned lip there is included a lateral slot 14 which is dimensioned to receive in close engagement preferably the leading tip 10 of the reel mounting foot 8 in a direct, male-female mating engagement or relationship. At the trailing end of the reel bracket 15 there is included compressive, locking means for locking in preferably the trailing tip 9 of the reel mounting foot 8. The compressive locking means is preferably formed by a longitudinally extended tab 11, which is disposed in face-to-face relationship with the main body of the bracket 15, and is actuated by screw 12 which passes through hole 13 and threadingly engages with threaded aperture **11*a* in the tab. As the screw 12 is tightened, the tab 11 is brought down toward the main body of the bracket 15, thus locking in compression the reel foot tip 9** between it and the main bracket body.

Thus, with screw 12 loosened and the tab 11 moved off to the side in a lateral direction, the reel 2 can be quickly and easily mounted on the adapter 20 by stabbing the leading tip 10 of the reel mounting foot 8 into the slot 14 (note FIG. 3) and lowering the trailing tip 9 into juxtaposition to tab 11, and mounting the tab 11 over the tip 9 and tightening the screw 12 until the foot 8 is locked onto the bracket 15. Likewise, by backing off on the screw 12, the reel 2 can be easily and quickly removed from the bracket 15 in the opposite fashion. After removal, the reel 2 is ready for storage or for use on a spinning rod for regular fishing. The bow 1 is also ready, as is, to be used in ordinary archery.

The operation of the combined assembly of the present invention in its preferred embodiment as applied to, but not limited to, the shooting of fish, is described as follows:

After the reel 2 had been attached to the bow 1 as described above, the line 6 is looped through a small hole in the trailing end of the arrow 3 or over the notched end of the arrow 3, as indicated in FIG. 1, making sure that the settings on the spinning reel 2 are set for launching the arrow, and the spinning reel 2 is running free. Care should be taken to see that there is not much slack in the line 6 at this point. The bow string 4 is pulled back and the arrow 3 released at some target in or on the water. To retrieve the arrow 3, the bowman grasps the bow 1 at its intermediate hand-hold point with one hand, and with the other operates the manual rewind 7 of the reel 2 and the thumb-stop button located at the trailing end of the reel 2.

The various possible applications of the present invention call for the following suggested materials of construction for the adapter 20: over fresh water — aluminum or other light metal or reinforced plastic parts; over salt water — plastic, stainless steel or bronze; under salt or fresh water — plastic, stainless steel, or bronze. Similarly, the attachment details of the bow mounting bracket 17 of the adapter 20 will depend upon the details of construction of the bow, and may be accompanied by wood screws, as in the preferred embodiment described, or a screwed-on clamp, or a screwless clamp that would encircle the body of the bow. When used for small animal hunting on land, recreation or fire fighting, the adapter should be designed for the strength of line used, still preserving its basic features of ease of attachment and disassembly. The use of bows of greater draw pull and of line of greater strength should require no basic modification in principle in the adapter 20, but may require beefed-up design for greater strength.

Should the reel not be of the general design shown in FIG. 5 but rather be of the design discussed above wherein the mounting foot extends up from the reel, the special adapter could be of the same general design and configuration described in detail above, except that the reel bracket section 15 preferably would be rotated in manufacture a 180° about a transverse, horizontal axis across its center and would be suitably dimensioned. Alternatively, the adapter 20 could be mounted on the other side of the bow 1 than as illustrated, resulting in the reel bracket section being downturned.

Additionally because the width and length of the mounting foot of the reel can vary from one type of reel to another, a downwardly projecting vertical stop could be provided on the terminal end of the upturned lip to prevent the leading tip of the mounting foot from projecting through the slot more than a desired distance. Such a stop would also prevent the compressive tab means from pushing the foot further forward through the slot until perhaps it lost its engagement with the trailing tip of the foot. Likewise, in order to allow flexibility of the longitudinal or lengthwise positioning of the compressive tab, the aperture 13 could be made in the form of a longitudinal slot rather than the circular hole illustrated.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. A combination comprising:

an archery bow having a hand-grip intermediate the ends of said bow;

a captive-type arrow associated with one side of the bow and embodying a shaft having an arrowhead on its leading end constructed to pierce and embed itself in a victim fish or the like;

a fishing line having one end attached to the shaft inwardly of the arrowhead on the shaft;

a standard fishing reel, the cooperating end of said line being wound on said reel, said reel including an extended mounting foot attached to one side of said reel and having a leading tip and a trailing tip; and a reel mounting adapter having three elemental sections a first, vertical mounting bracket attached to the bow at its handgrip portion;

an intermediate, horizontally disposed transverse arm section attached at one end to said first mounting bracket; and a second, at least generally horizontally disposed, longitudinally extended mounting bracket, upon which the reel is mounted and which is connected to the other end of said intermediate, transverse arm section; said second, longitudinally extended mounting bracket including at one end a transverse slot of a dimension to receive in close engagement one tip of the mounting foot of the reel, and at the other end easily engageable and disengageable compressive, locking means for locking in the other tip of the mounting foot of the reel, said one tip of the mounting foot being inserted in said slot in direct male-female mating engagement therewith and the other tip being held by said locking, compressive means; said second, longitudinally extended bracket including vertical edges extending vertically from its sides, and a slightly turned lip at its end that includes said transverse slot, said slot beginning at the beginning of said turned lip, the edges and the lip serving to position, locate and hold the mounting foot of the reel;

whereby the standard fishing reel can be easily and quickly detachably connected to the bow.

2. The combination of claim 1 wherein said slot is located at the leading end of said second mounting bracket and said one tip of the foot being the leading tip of the foot.

3. The combination of claim 2 wherein said compressive locking means includes a screw actuated, longitudinally extended tab which is disposed in face-to-face relationship with the main extended body of said second mounting bracket, said foot having an opposite tip said opposite tip being held between said tab and said main body.

4. The combination of claim 1 wherein said first mounting bracket includes two vertical wall sections at 90° to one another, both of which are in contact with the bow, the first one of which is connected to said intermediate arm section at the terminal edges of each and is in contact with the side of the bow opposite from that on which the arrow is associated, and the other one of which is connected to the trailing edge of the first wall section and is in contact with the belly of the bow.

5. The combination of claim 4 wherein said first wall section includes at least two diverging slots running in a generally vertical direction for use in connecting the adapter to the bow.

6. The combination of claim 1 wherein said turned lip is upturned, and said second, longitudinally extended bracket means includes a smooth floor surface upon which said mounting foot of said reel rests with said reel being positioned above said second bracket means.

7. A combination comprising; a bow having a handgrip intermediate the ends of the bow, a captive-type arrow associated with one side of the bow which embodies a shaft having an arrowhead on its leading end constructed to pierce and embed itself in a victim fish or the like, a reel and has a fishing line having one end attached to the shaft inwardly of the arrowhead on the shaft, the other end of the line being wound on said reel, and wherein the reel includes an extended mounting foot attached to one side of said reel which has a leading tip and a trailing tip, said adapter comprising:

first, vertical mounting bracket means for attaching the adapter to the bow at its hand-grip portion;

an intermediate, horizontally disposed, transverse arm section attached at one end to said first mounting bracket; and second, at least generally horizontally disposed, longitudinally extended mounting bracket means for mounting the reel connected to the other end of said intermediate, transverse arm section; said second, longitudinally extended mounting bracket means including at one end a transverse slot of a dimension to receive in close engagement one tip of the mounting foot of the reel in direct male-female mating engagement therewith, and at the other end easily engageable and disengageable compressive, locking means for locking in the other tip of the mounting foot of the reel between it and the main body of said second bracket means; said second, longitudinally extended bracket means including vertical edges extending vertically from its sides, amd a slightly turned lip at its end that includes said transverse slot, said slot beginning at the beginning of said turned lip, the edges and the lip serving to position, locate and hold the mounting foot of the reel when the reel is mounted on said second bracket means; whereby the reel can be easily and quickly detachably connected to the bow.

8. The combination of claim 7 wherein said slot is located at the leading end of said second mounting bracket means.

9. The combination of claim 8 wherein said compressive, locking means includes a screw actuated, longitudinally extended tab which is disposed in face-to-face relationship with the main extended body of said second mounting bracket means for holding the other end between said tab and said main body.

10. The adapter of claim 7 wherein said first mounting bracket means includes two vertical wall sections at ninety degrees to one another, both of which are for contacting the bow, the first one of which is connected to said intermediate arm section at the terminal edges of each and is for contacting the side of the bow opposite from that on which the arrow is associated, and the other one of which is connected to the trailing edge of the first wall section and is for contacting the belly of the bow.

11. The combination of claim 10 wherein said first wall section includes at least two slots running in at least a generally vertical direction for use in connecting the adapter to the bow by means of straps placed through the slots and around the body of the bow.

12. The combination of claim 7 wherein said turned lip is upturned, and said second, longitudinally extended bracket means includes a smooth floor surface upon which the mounting foot of the reel rests when the reel is mounted on said second bracket means, the reel then being positioned above said second bracket means.

* * * * *